US009218014B2

(12) United States Patent
Daigle

(10) Patent No.: US 9,218,014 B2
(45) Date of Patent: Dec. 22, 2015

(54) SUPPLY VOLTAGE INDEPENDENT BANDGAP CIRCUIT

(71) Applicant: Fairchild Semiconductor Corporation, San Jose, CA (US)

(72) Inventor: Tyler Daigle, Portland, ME (US)

(73) Assignee: FAIRCHILD SEMICONDUCTOR CORPORATION, San Jose, CA (US)

( * ) Notice: Subject to any disclaimer, the term of this patent is extended or adjusted under 35 U.S.C. 154(b) by 125 days.

(21) Appl. No.: 14/061,177

(22) Filed: Oct. 23, 2013

(65) Prior Publication Data

US 2014/0117968 A1 May 1, 2014

Related U.S. Application Data

(60) Provisional application No. 61/718,513, filed on Oct. 25, 2012.

(51) Int. Cl.
*G05F 3/26* (2006.01)
*G05F 3/24* (2006.01)
(Continued)

(52) U.S. Cl.
CPC ..... *G05F 3/267* (2013.01); *G05F 3/242* (2013.01); *G05F 3/247* (2013.01); *G05F 3/262* (2013.01); *G05F 3/30* (2013.01); *G05F 3/02* (2013.01); *G05F 3/26* (2013.01)

(58) Field of Classification Search
CPC ..... G05F 3/22; G05F 3/222; G05F 3/227; G05F 3/26; G05F 3/262; G05F 3/242; G05F 3/247; G05F 3/267; G05F 3/30
USPC ..... 323/313, 314
See application file for complete search history.

(56) References Cited

U.S. PATENT DOCUMENTS 8,089,260 B2 1/2012 Yang
2006/0145762 A1 7/2006 Leete
(Continued)

FOREIGN PATENT DOCUMENTS

CN 1662863 A 8/2005
CN 1672110 A 9/2005
CN 101329586 A 12/2008
CN 103777669 A 5/2014
KR 102014005288 A 5/2014

OTHER PUBLICATIONS

"Chinese Application Serial No. 201310516368.9, Office Action mailed Feb. 2, 2015", with English translation of claims, 7 pgs.
(Continued)

*Primary Examiner* — Fred E Finch, III
*Assistant Examiner* — Rafael O De Leon Domenech
(74) *Attorney, Agent, or Firm* — Schwegman Lundberg & Woessner, P.A.

(57) ABSTRACT

This application discusses apparatus and methods for reducing supply voltage induced band gap voltage variation. In an example, a method of compensating a reference voltage current source for supply voltage variation can include providing at least a portion if a reference current for establishing the reference voltage using a first output transistor coupled to the supply voltage, maintaining a constant voltage across the first output transistor using a second output transistor coupled between the first output transistor and an output node, modulating a compensation impedance between a first node and ground as the supply voltage varies, the first node located where the first output transistor is coupled to the second output transistor, and wherein the modulating includes modulating the compensation impedance to substantially equal an output impedance, the output impedance measured between an output node and an input for the supply voltage.

17 Claims, 5 Drawing Sheets

(51) Int. Cl.
*G05F 3/30* (2006.01)
*G05F 3/02* (2006.01)

(56) References Cited

U.S. PATENT DOCUMENTS

2008/0169795 A1 7/2008 Wang
2010/0164465 A1* 7/2010 Yang ..... 323/313
2012/0229199 A1* 9/2012 Tseng ..... 327/539

OTHER PUBLICATIONS

"Chinese Application Serial No. 201310516368.9, Response filed Feb. 6, 2015", with English translation of claims, 20 pgs.
"Chinese Application Serial No. 201320664910.0, Notification to make Rectification mailed Feb. 24, 2014", w/English Claims, 8 pgs.

* cited by examiner

SUPPLY VOLTAGE INDEPENDENT BANDGAP CIRCUIT

CLAIM OF PRIORITY

This patent application claims the benefit of priority, under 35 U.S.C. Section 119(e), to Daigle, U.S. Provisional Patent Application Ser. No. 61/718,513, entitled "IMPROVED SUPPLY VOLTAGE INDEPENDENT BANDGAP CIRCUIT," filed on Oct. 25, 2012, which is hereby incorporated by reference herein in its entirety.

BACKGROUND

Electronic devices can rely on one or more band gap voltages, or reference voltages, for various calibration, measurement or triggering functions. When a band gap voltage various from a predetermined value, the performance and reliability of an associated electronic device can be compromised. Supply voltage variation to band gap circuits can be a significant cause of band gap voltage variation.

OVERVIEW

This application discusses apparatus and methods for reducing supply voltage induced band gap voltage variation. In an example, a method of compensating a reference voltage current source for supply voltage variation can include providing at least a portion if a reference current for establishing the reference voltage using a first output transistor coupled to the supply voltage, maintaining a constant voltage across the first output transistor using a second output transistor coupled between the first output transistor and an output node, modulating a compensation impedance between a first node and ground as the supply voltage varies, the first node located where the first output transistor is coupled to the second output transistor, and wherein the modulating includes modulating the compensation impedance to substantially equal an output impedance, the output impedance measured between an output node and an input for the supply voltage.

This section is intended to provide an overview of subject matter of the present patent application. It is not intended to provide an exclusive or exhaustive explanation of the invention. The detailed description is included to provide further information about the present patent application

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventors have recognized example apparatus and methods for a band gap circuit with improved supply voltage independence. In certain examples, a current mirror can be used to match Norton equivalent resistance present in a current source and can apply the resistance in a way that can cancel out a supply voltage coefficient, thus, making the band gap circuit more independent of supply voltage level.

Figure 1:
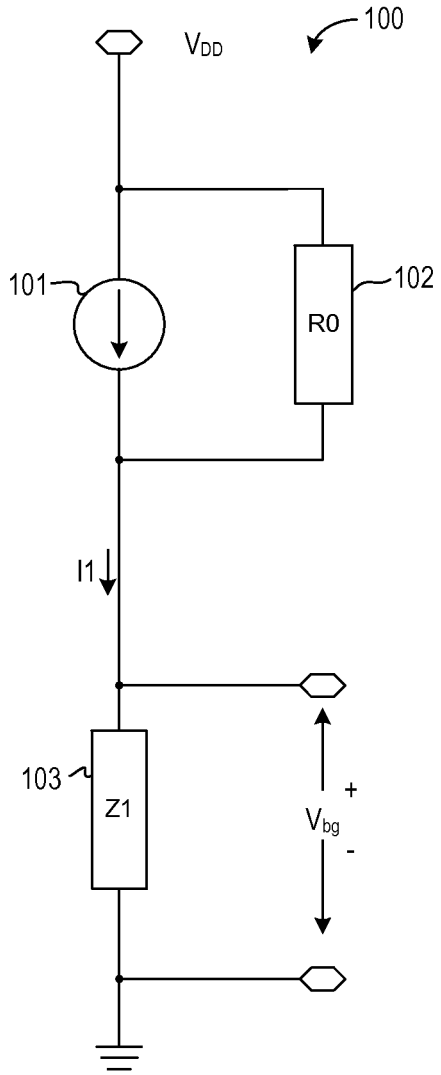
FIG. 1 illustrates generally an example Norton equivalent model of a final stage of a typical band gap circuit.

FIG. 1 illustrates generally a typical band gap circuit 100. The example band gap circuit can include an ideal current source 101 with finite output impedance 102. The current source can be coupled to a supply voltage ($V_{DD}$) and can supply a reference current ($I_1$) to a load 103 to establish a band gap voltage ($V_{bg}$). A band gap voltage can sometimes be referred to as a reference voltage.

The band gap voltage ($V_{bg}$) can be calculated as:

$$V_{bg} = V_{DD}\frac{Z1}{Z1 + Ro} + I_1\frac{Ro \cdot Z1}{Ro + Z1}$$

Note that the band gap voltage, or reference voltage, can vary as the supply voltage ($V_{DD}$) varies. The supply voltage dependence of the band gap voltage ($V_{bg}$) can limit the performance of electronic devices that use the band gap voltage ($V_{bg}$) for calibration or threshold purposes.

Figure 2A:
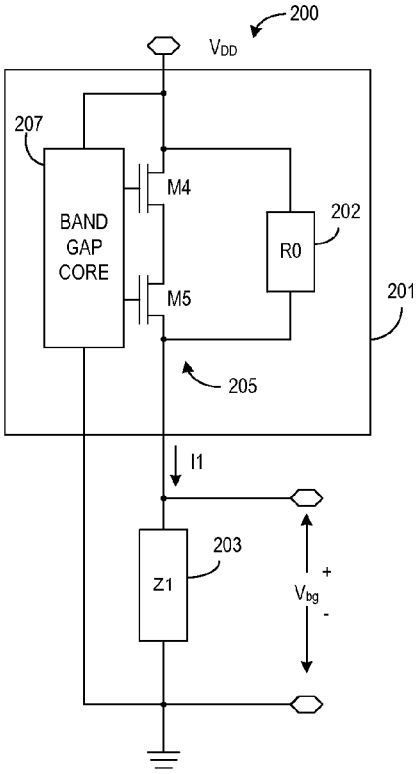
FIGS. 2A and 2B illustrate generally an improved band gap circuit.
Figure 2B:
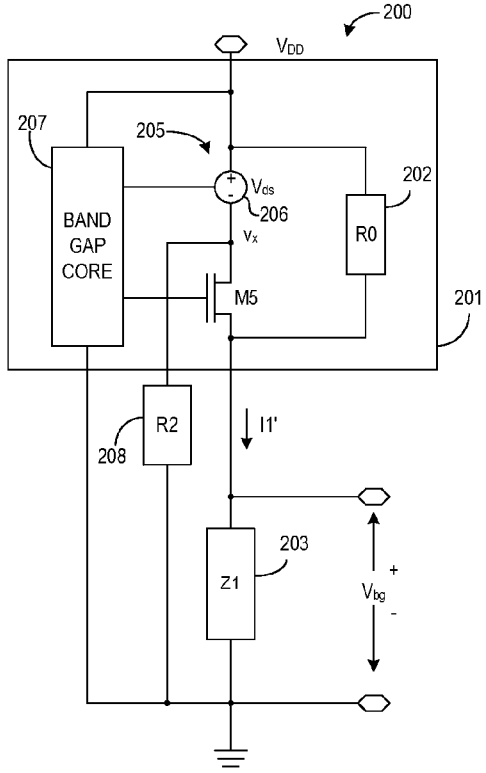

FIGS. 2A and 2B illustrate a current source circuit 200 including a cascoded output stage 205 for providing a reference voltage such as a band gap voltage ($V_{bg}$). In certain examples, an output stage 205 of the current source 201 can be cascoded and can provide a constant voltage ($V_{ds}$) such that a portion if the output stage 205 can be modeled as an ideal voltage source 206. FIG. 2A illustrates generally a current source circuit 200 including a band gap core 207 and a cascoded output stage 205, and a load 203. The output stage 205 can include a first transistor (M4) and a second transistor (M5) cascoded and coupled to a load 203 to provide the reference or band gap voltage ($V_{bg}$). In certain examples, the first transistor (M4) can modulate the reference current (I1') to the load. In some examples, the second transistor (M5) can maintain a constant voltage ($V_{ds}$) across the first transistor (M4). As used herein, maintaining a constant voltage ($V_{ds}$) can mean that although the voltage across the first transistor (M4) is not exactly constant, the second transistor (M5) can keep the voltage across the first transistor (M4) closer to a particular voltage than if the second transistor (M5) was not there. The current source circuit 200 can include a finite output impedance (R0) 202 and as discussed above can allow the band gap voltage ($V_{bg}$) to vary as the supply voltage ($V_{DD}$) to the current source circuit 200 varies. The inventors have recognized that adding a second impedance (R2) 208 can allow the current source circuit 200 to provide a reference voltage ($V_{bg}$) that is isolated from, or is less susceptible to, variations of the supply voltage ($V_{DD}$).

FIG. 2B thus illustrates the example current source circuit 200 of FIG. 2A with the first transistor (M4) replaced with an ideal voltage source 206 since cascoding the first and second transistors (M4, M5) can provide constant drain-to-source voltage ($V_{ds}$) across the first transistor (M4). The following equations summarize the calculation of the band gap voltage ($V_{bg}$) when the current source circuit 200 includes the second impedance (R2) 208.

Use superposition to solve for $V_{bg}$ with respect to $V_{DD}$, where $$V_x = V_{DD} - V_{ds},$$

and $$I1' = I1 - \frac{V_x}{R2}.$$

$$V_{bg} = V_{DD}\frac{Z1}{Z1+R0} + I1'\frac{R0Z1}{R0+Z1}$$

$$V_{bg} = V_{DD}\frac{Z1}{Z1+R0} + \left(I1 - \frac{V_x}{R2}\right)\frac{R0Z1}{R0+Z1}$$

$$V_{bg} = V_{DD}\frac{Z1}{Z1+R0} + I1\frac{R0Z1}{R0+Z1} - V_x\frac{R0Z1}{R2(R0+Z1)}$$

$$V_{bg} = I1\frac{R0Z1}{R0+Z1} + V_{DD}\left(\frac{Z1}{Z1+R0} - \left(1 - \frac{V_{ds}}{V_{DD}}\right)\frac{R0Z1}{R2(R0+Z1)}\right)$$

$$V_{bg} = I1\frac{R0Z1}{R0+Z1} + V_{ds}\frac{R0Z1}{R2(R0+Z1)} + V_{DD}\left(\frac{Z1}{Z1+R0} - \frac{R0Z1}{R2(R0+Z1)}\right)$$

Set $R2 = R0$, $$V_{bg} = I1\frac{R0Z1}{R0+Z1} + V_{ds}\frac{R0Z1}{R2(R0+Z1)}$$

Thus, if R2=R0, the band gap voltage ($V_{bg}$) does not depend on the supply voltage ($V_{DD}$).

Figure 3:
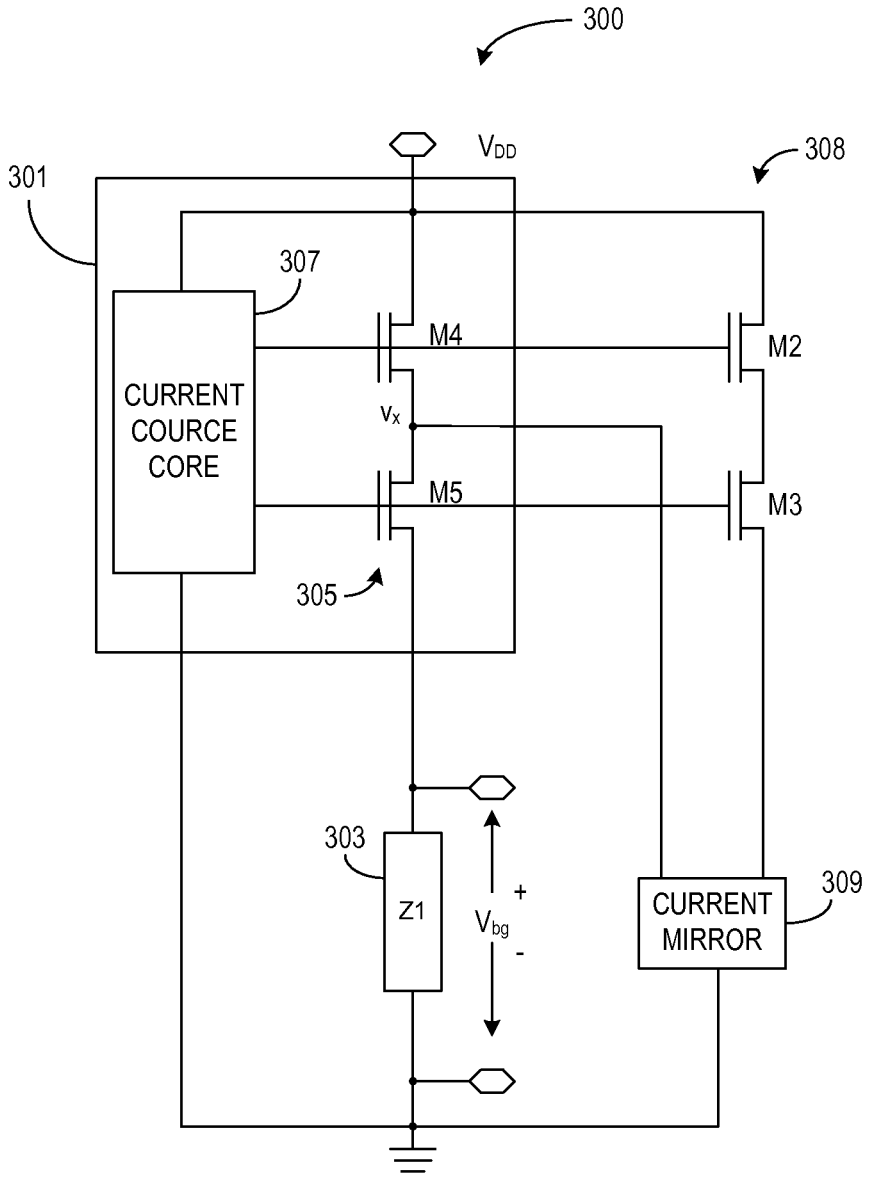
FIG. 3 illustrates generally an improved band gap circuit including an compensation circuit.

In certain examples, the second impedance (R2) 208 can be configured to match the output impedance (Ro) 202 and can be provided using an additional current source. The additional current source current can be mirrored and applied to the "$V_x$" node as shown in FIG. 3. The original current (I1) through M4 of FIG. 2A, or the current through ideal voltage source 206 of FIG. 2B, can be doubled to account for increased DC current draw.

FIG. 3 illustrates an examples current source circuit 300 including an example impedance circuit 308. In certain examples, the example current source circuit 300 can include a current source 301, a load 303, and an impedance circuit 308. The current source can include a current source core 307 and an output stage 305. The current source can include an output impedance (not shown). The output stage can include a first output transistor M4 coupled to a voltage supply providing a supply voltage ($V_{DD}$), and second output transistor M5 coupled to a load 303 to provide a band gap voltage ($V_{bg}$). The impedance circuit 308 can modulate a compensation impedance between a first node ($V_x$) of the output stage 305 and ground and can include a current mirror 309 coupled to the node ($V_x$) located where the first output transistor (M4) is coupled to the second transistor (M5). The current mirror 309 can modulate current provided by the current source 301 to reduce the supply voltage ($V_{DD}$) dependence of the band gap voltage ($V_{bg}$). In certain examples, the impedance circuit 308 can include a first compensation transistor (M2) and a second compensation transistor (M3) cascoded to provide a sense current to the current mirror 309. In certain examples, the current mirror can provide a 1:1 mirroring of the sense current. In certain examples, a control node of the first compensation transistor (M2) can be coupled to a control node of the first output transistor (M4) and the control node of the second compensation transistor (M3) can be coupled to a control node of the second output transistor (M5).

Figure 4:
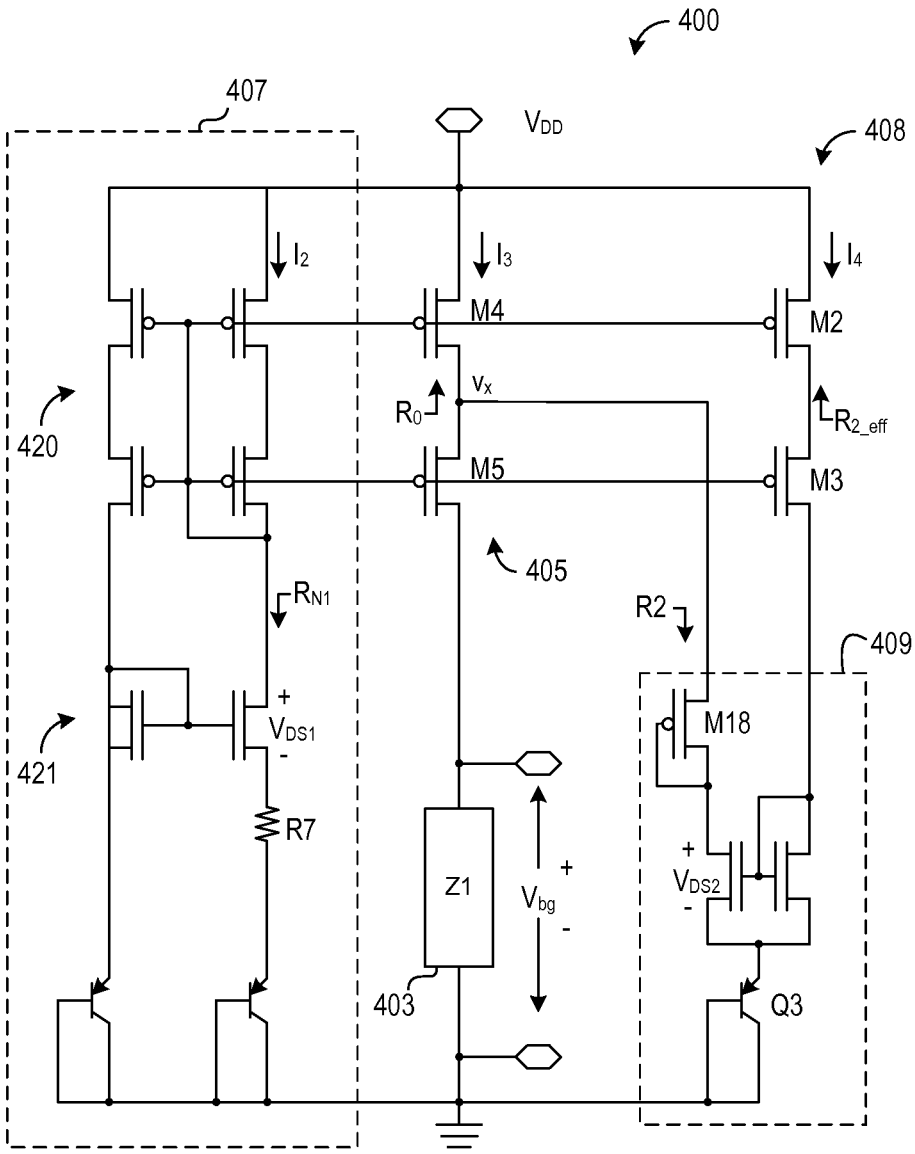
FIG. 4 illustrates generally a detailed example band gap circuit.

FIG. 4 illustrates generally a detailed example band gap circuit 400. In certain examples, the example band gap circuit can include a current source core 407, a cascode current source output stage 405, a impedance circuit 408 including a current mirror 409, and a load 403 for providing a band gap voltage ($V_{bg}$). The example of FIG. 4 includes notations for various impedances (Ro, R2_eff, Rn1, R2) useful for understanding the voltage independence improvements. In certain examples, the output impedance R0 of the current source can be matched with the output impedance R2 of the current sink of the current mirror 409 to improve or eliminate dependence of the band gap voltage ($V_{bg}$) on the supply voltage ($V_{DD}$). In certain examples, matching the output impedances can take into consideration the output impedance (Ro) of devices in the band gap core 407 such as a CMOS $V_T$ referenced self-biased circuit. Derivation of the circuit of the FIG. 4 is illustrated below:

We want R2=R0.

$$R0 = \frac{Rn1}{2},$$

because I3=2(I2).

Substituting R2 for R0, $$R2 = \frac{Rn1}{2},$$

because I4 is mirrored with a 1:1 ratio with matched, uncascoded NMOS devices.

In certain examples, further matching of the output impedances can be achieved by matching the drain-source voltages (vds1, vds2) of the mirror transistors associated with Rn1 and R2. In an example, the drain-source voltages can be matched by adding diode connected PMOS transistor (M18) and a bipolar transistor (Q3). In certain examples, the current source core 407 can include a PMOS-based current mirror stage 420 and a NMOS-based current mirror stage 421. In some examples, the PMOS-based current mirror stage 420 can bias the NMOS-based current mirror stage 421 and the NMOS-based current mirror stage 421 can bias the PMOS-based current mirror stage 420. IN certain examples, a resistor (R7) of the current source core 407 can be used to set the value of the band gap voltage ($V_{bg}$).

Figure 5:
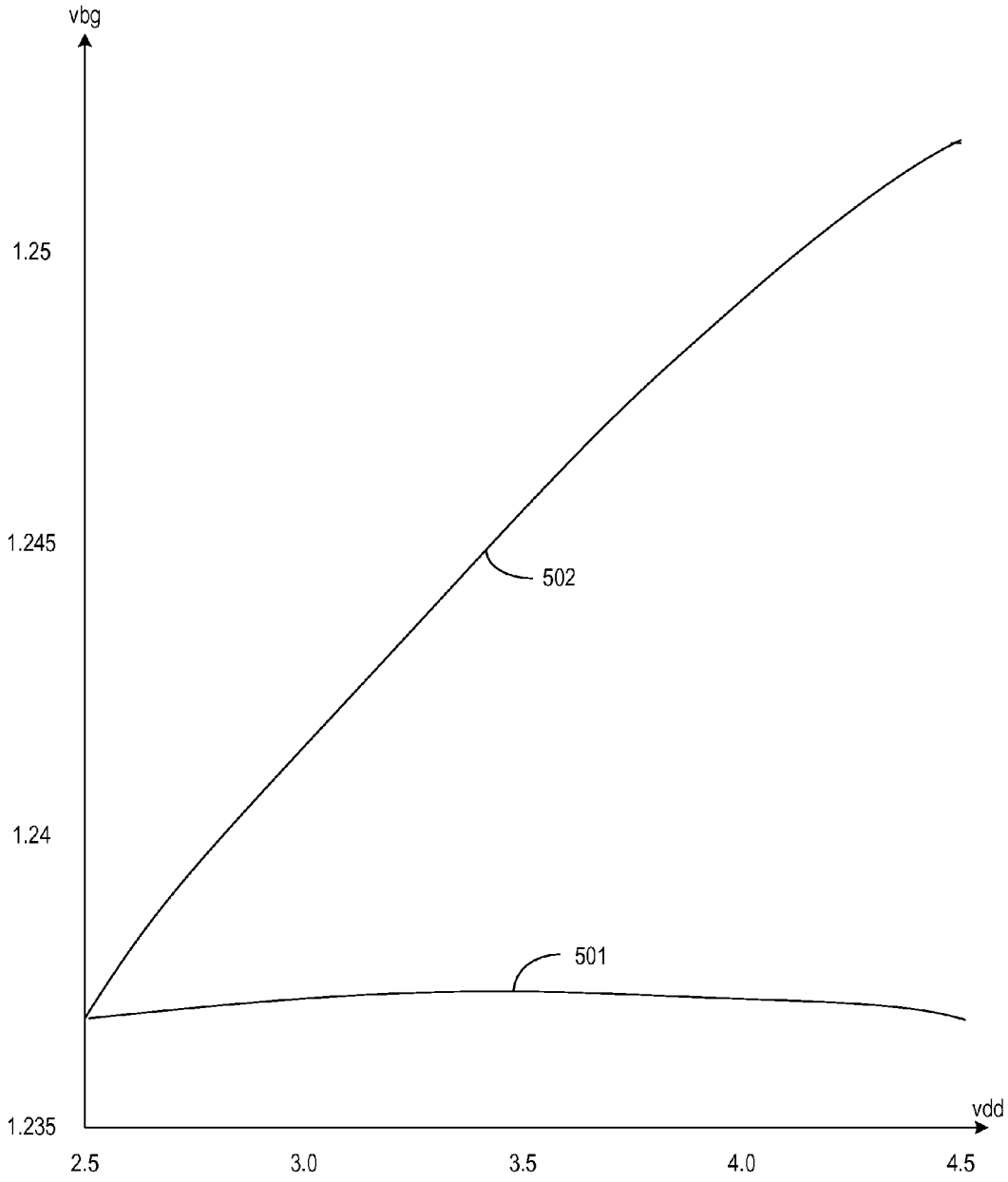
FIG. 5 illustrates improved supply voltage independence of an example improved band gap circuit compared to the supply voltage dependence of an uncompensated band gap circuit.

FIG. 5 illustrates improved supply voltage independence of an example band gap circuit compared to the supply voltage dependence of an uncompensated CMOS $V_T$ referenced self-biased circuit. The plot shows that band gap voltage 501 of the improved example circuit varies less than about 0.0005 volts when the supply voltage varies between about 2.5 volts and about 4.5 volts. The band gap voltage 502 of an uncompensated CMOS $V_T$ referenced self-biased circuit can vary about 0.016 volts over the same supply voltage range.

Additional Notes

In Example 1, a current source circuit having an improved supply voltage coefficient can include a current source and an impedance circuit. The current source can include a first output transistor configured to provide at least a portion of a reference current to establish a reference voltage across a load, a second output transistor coupled between the first output transistor and the load, and configured to maintain a constant voltage across the first output transistor, wherein the first output transistor is configured to couple to a voltage supply and the second output transistor is configured to couple to the load at an output node, and wherein the first and second output transistors include an output impedance between the output node and a voltage supply input. The impedance circuit can be configured to modulate a compensation impedance between a first node and ground as a supply voltage of the voltage supply varies, the first node located where the first output transistor is coupled to the second output transistor, wherein the compensation impedance is substantially equal to the output impedance.

In Example 2, the impedance circuit of Example 1 optionally includes a current mirror configured modulate current through the first output transistor to isolate the reference voltage from variations in the supply voltage.

In Example 3, the impedance circuit of any one or more of Examples 1-2 optionally includes first and second compensation transistors configured to couple between the voltage supply and the current mirror and to provide a sense current to the current mirror.

In Example 4, the first compensation transistor of any one or more of Examples 1-3 optionally includes a control node coupled to a control node of the first output transistor.

In Example 5, the second compensation transistor of any one or more of Examples 1-4 optionally includes a control node coupled to a control node of the second output transistor.

In Example 6, the current source of any one or more of Examples 1-5 optionally includes a PMOS-based current mirror stage, a NMOS-based current mirror stage, wherein the PMOS-based current mirror stage is configured to bias the NMOS-based current mirror stage, wherein the NMOS-based current mirror stage is configured to bias the PMOS-based current mirror stage, and wherein a first control node of the PMOS-based current mirror stage is coupled to a control node of the first output transistor.

In Example 7, a second control node of the PMOS-based current mirror stage of any one or more of Examples 1-6 optionally is coupled to a control node of the second output transistor.

In Example 8, the current source of any one or more of Examples 1-7 optionally includes a current definition transistor coupled in series with a mirror transistor of the PMOS-based current mirror stage and a sense transistor of the NMOS-based current mirror stage.

In Example 9, a method of compensating a reference voltage current source for supply voltage variation can include providing at least a portion if a reference current for establishing the reference voltage using a first output transistor coupled to the supply voltage, maintaining a constant voltage across the first output transistor using a second output transistor coupled between the first output transistor and an output node, modulating a compensation impedance between a first node and ground as the supply voltage varies, the first node located where the first output transistor is coupled to the second output transistor, and wherein the modulating includes modulating the compensation impedance to substantially equal an output impedance, the output impedance measured between an output node and an input for the supply voltage.

In Example 10, the modulating a compensation impedance of any one or more of Examples 1-9 optionally includes modulating current through the first output transistor to isolate the reference voltage from variations in the supply voltage using a current mirror coupled to the first node.

In Example 11, the method of any one or more of Examples 1-10 optionally includes providing a sense current to the current mirror using first and second compensation transistors coupled between the voltage supply and the current mirror.

In Example 12, the method of any one or more of Examples 1-11 optionally includes controlling a control node of the first compensation transistor using a first control signal coupled to a control node of the first output transistor.

In Example 13, a system for providing a reference voltage with a reduced supply voltage coefficient can include a current source circuit configured to provide a reference current, a load configured to provide the reference voltage using the reference current; and an impedance circuit. The current source circuit can include a current source including a first output transistor configured to provide at least a portion of the reference current to establish the reference voltage across a load, and a second output transistor coupled between the first output transistor and the load, and configured to maintain a constant voltage across the first output transistor. The first output transistor can be configured to couple to a voltage supply and the second output transistor can be configured to couple to the load at an output node. The first and second output transistors can include an output impedance between the output node and a voltage supply input. The impedance circuit can be configured to modulate a compensation impedance between a first node and ground as a supply voltage of the voltage supply varies, the first node located where the first output transistor is coupled to the second output transistor, wherein the compensation impedance is substantially equal to the output impedance.

In Example 14, the impedance circuit of any one or more of Examples 1-13 optionally includes a current mirror configured modulate current through the first output transistor to isolate the reference voltage from variations in the supply voltage.

In Example 15, the impedance circuit of any one or more of Examples 1-14 optionally includes first and second compensation transistors configured to couple between the voltage supply and the current mirror and to provide a sense current to the current mirror.

In Example 16, the first compensation transistor of any one or more of Examples 1-15 optionally includes a control node coupled to a control node of the first output transistor.

In Example 17, the second compensation transistor of any one or more of Examples 1-16 optionally includes a control node coupled to a control node of the second output transistor.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A current source circuit having an improved supply voltage coefficient, the current source circuit comprising;

a current source including;

a first output transistor configured to provide at least a portion of a reference current to establish a reference voltage across a load; and a second output transistor coupled between the first output transistor and the load, and configured to maintain a constant voltage across the first output transistor; and wherein the first output transistor is configured to couple to a voltage supply and the second output transistor is configured to couple to the load at an output node; and wherein the first and second output transistors include an output impedance between the output node and a voltage supply input; and an impedance circuit coupled directly to a first node, the impedance circuit configured to modulate a compensation impedance between the first node and ground as a supply voltage of the voltage supply varies, the first node located where the first output transistor is coupled to the second output transistor, wherein the compensation impedance is substantially equal to the output impedance.

2. The current source circuit of claim 1, wherein the impedance circuit includes a current mirror configured modulate current through the first output transistor to isolate the reference voltage from variations in the supply voltage.

3. The current source circuit of claim 2, wherein the impedance circuit includes first and second compensation transistors configured to couple between the voltage supply and the current mirror and to provide a sense current to the current mirror.

4. The current source circuit of claim 3, wherein the first compensation transistor includes a control node coupled to a control node of the first output transistor.

5. The current source circuit of claim 4, wherein the second compensation transistor includes a control node coupled to a control node of the second output transistor.

6. The current source circuit of claim 1, wherein the current source includes:

a PMOS-based current mirror stage;

a NMOS-based current mirror stage;

wherein the PMOS-based current mirror stage is configured to bias the NMOS-based current mirror stage;

wherein the NMOS-based current mirror stage is configured to bias the PMOS-based current mirror stage; and wherein a first control node of the PMOS-based current mirror stage is coupled to a control node of the first output transistor.

7. The current source circuit of claim 6, wherein a second control node of the PMOS-based current mirror stage is coupled to a control node of the second output transistor.

8. The current source circuit of claim 7, wherein the current source includes a current definition transistor coupled in series with a mirror transistor of the PMOS-based current mirror stage and a sense transistor of the NMOS-based current mirror stage.

9. A method of compensating a reference voltage current source for supply voltage variation, the method comprising:

providing at least a portion if a reference current for establishing the reference voltage using a first output transistor coupled to the supply voltage;

maintaining a constant voltage across the first output transistor using a second output transistor coupled between the first output transistor and an output node;

modulating a compensation impedance between a first node and ground as the supply voltage varies using an impedance circuit coupled directly to a first node, the first node located where the first output transistor is coupled to the second output transistor; and wherein the modulating includes modulating the compensation impedance to substantially equal an output impedance, the output impedance measured between an output node and an input for the supply voltage.

10. The method of claim 9, wherein modulating a compensation impedance includes modulating current through the first output transistor to isolate the reference voltage from variations in the supply voltage using a current mirror coupled to the first node.

11. The method of claim 10, including providing a sense current to the current mirror using first and second compensation transistors coupled between the voltage supply and the current mirror.

12. The method of claim 11, including controlling a control node of the first compensation transistor using a first control signal coupled to a control node of the first output transistor.

13. A system for providing a reference voltage with a reduced supply voltage coefficient, the system comprising:

a current source circuit configured to provide a reference current;

a load configured to provide the reference voltage using the reference current; and wherein the current source circuit includes:

a current source including;

a first output transistor configured to provide at least a portion of the reference current to establish the reference voltage across a load; and a second output transistor coupled between the first output transistor and the load, and configured to maintain a constant voltage across the first output transistor; and wherein the first output transistor is configured to couple to a voltage supply and the second output transistor is configured to couple to the load at an output node; and wherein the first and second output transistors include an output impedance between the output node and a voltage supply input; and an impedance circuit coupled directly to a first node, the impedance circuit configured to modulate a compensation impedance between the first node and ground as a supply voltage of the voltage supply varies, the first node located where the first output transistor is coupled to the second output transistor, wherein the compensation impedance is substantially equal to the output impedance.

14. The system of claim 13, wherein the impedance circuit includes:

a current mirror configured modulate current through the first output transistor to isolate the reference voltage from variations in the supply voltage.

15. The system of claim 14, wherein the impedance circuit includes first and second compensation transistors configured to couple between the voltage supply and the current mirror and to provide a sense current to the current mirror.

16. The system of claim 15, wherein the first compensation transistor includes a control node coupled to a control node of the first output transistor.

17. The system of claim 16, wherein the second compensation transistor includes a control node coupled to a control node of the second output transistor.

* * * * *